US007744782B2

(12) United States Patent
Inaba et al.

(10) Patent No.: US 7,744,782 B2
(45) Date of Patent: Jun. 29, 2010

(54) TRANSPARENT CONDUCTOR

(75) Inventors: Kazuhisa Inaba, Tokyo (JP); Noriyuki Yasuda, Tokyo (JP); Hiroshi Chihara, Tokyo (JP)

(73) Assignee: TDK Corporation, Tokyo (JP)

( * ) Notice: Subject to any disclaimer, the term of this patent is extended or adjusted under 35 U.S.C. 154(b) by 60 days.

(21) Appl. No.: 12/197,465

(22) Filed: Aug. 25, 2008

(65) Prior Publication Data

US 2009/0057625 A1 Mar. 5, 2009

(30) Foreign Application Priority Data

Aug. 30, 2007 (JP) ..... P2007-224589
Aug. 15, 2008 (JP) ..... P2008-209293

(51) Int. Cl.
*H01B 1/20* (2006.01)

(52) U.S. Cl. ..... 252/519.51; 252/520.1

(58) Field of Classification Search ..... 252/519.5, 252/519.51, 520.1; 428/918, 931
See application file for complete search history.

(56) References Cited

U.S. PATENT DOCUMENTS 6,480,250 B1 * 11/2002 Matsufuji et al. ..... 349/113
2005/0233131 A1 * 10/2005 Nishida et al. ..... 428/323
2006/0222855 A1 * 10/2006 Yasuda ..... 428/411.1
2006/0269737 A1 11/2006 Yasuda et al.
2009/0262431 A1 * 10/2009 Asakura et al. ..... 359/601

FOREIGN PATENT DOCUMENTS

JP 2003027216 * 1/2003
JP A-2003-27003 1/2003
JP A-2006-202738 8/2006
JP A-2006-310195 11/2006
JP A-2007-161543 6/2007
JP A-2008-231367 10/2008
JP 2009013358 * 1/2009

OTHER PUBLICATIONS

Machine English Translation of JP2003-027003A.*
Machine English Translation of JP2008-231367A.*

* cited by examiner

*Primary Examiner*—Mark Kopec
(74) *Attorney, Agent, or Firm*—Oliff & Berridge, PLC

(57) ABSTRACT

It is an object of the present invention to provide a transparent conductor exhibiting a small increase in resistance value even when used under high-humidity conditions over long periods of time. A transparent conductor in a preferred embodiment comprises indium tin oxide, an additive component having zinc oxide as a main component thereof, and a resin cured product, the content of the additive component being 0.1 to 50 wt % relative to the total amount of indium tin oxide and the additive component.

2 Claims, 3 Drawing Sheets

TRANSPARENT CONDUCTOR

BACKGROUND OF INVENTION

1. Field of the Invention

The present invention relates to a transparent conductor.

2. Related Background Art

Transparent electrodes are widely used in display devices such as LCD, PDP, organic EL, touch panels and the like. Many such transparent electrodes are formed of a transparent conductor comprising, for instance, indium tin oxide (hereinafter "ITO" for short). Known such transparent conductors include, for instance, transparent conductors formed of a material comprising conductive oxide microparticles that contain, among others, indium oxide, tin oxide and/or zinc oxide, as disclosed in Japanese Patent Application Laid-open No. 2006-202738.

SUMMARY OF THE INVENTION

The above-described display devices have come to be used in a variety of applications. Display devices are thus increasingly exposed to harsh environments in terms of, for instance, high temperature and high humidity. Research by the inventors has shown that the above-described conventional transparent conductors can function as conductors having initially low resistance. When used over long periods of time in high-humidity environments, however, the resistance value often increases considerably as compared with the initial value, whereby the transparent conductor fails to function fully as a conductor.

In the light of the above, it is an object of the present invention to provide a transparent conductor exhibiting a small increase in resistance value even when used under high-humidity conditions over long periods of time.

With a view to achieving the above goal, the transparent conductor of the present invention comprises indium tin oxide (ITO), an additive component having zinc oxide (ZnO) as a main component thereof, and a resin cured product, wherein the content of the additive component is 0.1 to 50 wt % relative to the total amount of indium tin oxide and the additive component.

By blending the ITO with the additive component having ZnO as a main component thereof, in the above-described specific content ratios, the transparent conductor of the present invention exhibits a resistance low enough that enables it to function as a conductor. Moreover, increases in resistance value can be kept sufficiently small even when the transparent conductor is exposed to a high-humidity environment over long periods of time. As is known, ITO has excellent transparency, and low resistance, and hence is ideal as a material for transparent conductors. However, ITO is highly susceptible to exhibiting increases in resistance caused by moisture or the like. Meanwhile, ZnO has very high resistance, and is more susceptible than ITO to exhibiting increases in resistance on account of moisture. Ordinarily, therefore, ZnO can hardly function as conductor by itself. Despite the above conventional tendencies, the present invention is based on the unexpected finding to the effect that adding specific amounts of ZnO to a transparent conductor allows sufficiently reducing both resistance value and humidity-dependent resistance value changes.

In the above transparent conductor of the present invention, more preferably, the additive component is zinc oxide doped with gallium (Ga) or aluminum (Al). The resistance value of the additive component itself can be reduced thereby, which in turn allows further reducing the resistance value of the transparent conductor.

Also, the additive component comprises preferably insulating particles having zinc oxide as a main component thereof. The effect to be able to lower a resistance value changes while maintaining low resistance by combining the additive component and ITO can be brought out better when the additive component is in the form of insulating particles.

Moreover, the additive component may comprise insulating particles having adhered to the surface thereof at least one of alumina, silica and a resin. The additive component in the form of insulating particles has good stability to temperature and humidity, which allows further suppressing resistance increases, owing to moisture or the like, in the transparent conductive layer.

The present invention can thus provide a transparent conductor, having sufficiently low resistance for practical use, and exhibiting a small increase in resistance value, even when used under high-humidity conditions over long periods of time.

DESCRIPTION OF THE PREFERRED EMBODIMENTS

Figure 1:
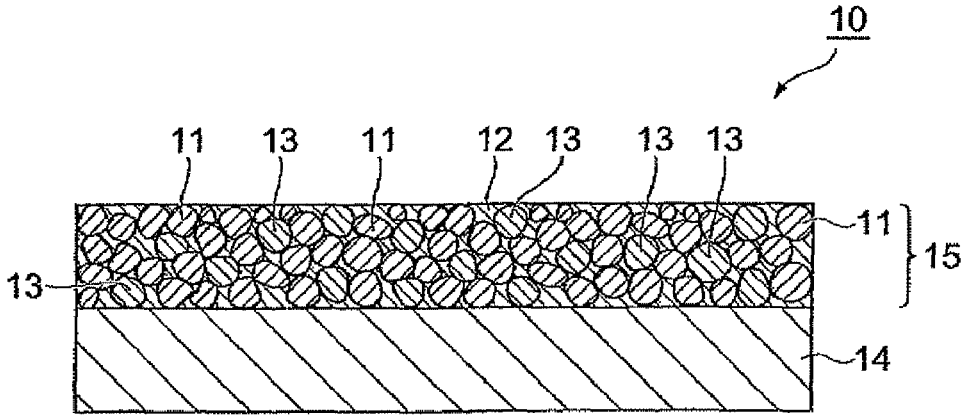
FIG. 1 is a diagram illustrating schematically the cross-sectional constitution of a transparent conductive film using a transparent conductor according to a preferred embodiment.

Preferred embodiments of the present invention are explained next with reference to accompanying drawings. In the drawings, identical elements are denoted with identical reference numerals, and recurrent explanations thereof are omitted.

FIG. 1 is a diagram illustrating schematically the cross-sectional constitution of a transparent conductive film using a transparent conductor according to a preferred embodiment. As illustrated in FIG. 1, a transparent conductive film 10 comprises a substrate 14 and a transparent conductive layer 15 formed on the substrate 14. In the transparent conductive film 10, the transparent conductive layer 15 is formed of a transparent conductor according to a preferred embodiment of the present invention.

The substrate 14 is not particularly limited, provided that it comprises a material that is transparent to visible light. As the substrate 14, there can be used, for instance, glass, transparent resin films such as polyester, polyethylene, polypropylene, polyethylene terephthalate (PET) films or the like, as well as various transparent plastic substrates. The transparent conductive layer 15 comprises multiple ITO particles 11 and ZnO particles 13 dispersed in a resin cured product 12. That is, the transparent conductive layer 15 is formed by a transparent conductor comprising the ITO particles 11, the ZnO particles 13 and a resin. The transparent conductive layer 15 comprises, for the most part, the ITO particles 11 and the ZnO particles 13. In other words, therefore, the transparent conductive layer 15 can be said to be an aggregate of the ITO particles 11 and the ZnO particles 13, with the resin cured product 12 arranged in the interstices between the particles.

The ITO particles 11 are particles comprising so-called ITO, which is a complex oxide of indium and tin. The primary particle size of the ITO particles 11 is preferably 0.005 to 0.5 μm, more preferably 0.02 to 0.08 μm. When the ITO particles 11 have a primary particle size smaller than the above range, oxygen vacancies, which underlie conductivity, form less readily than when the primary particle size falls within the above range. As a result, stable conductivity is less likely to be achieved in the transparent conductive layer 15. When the primary particle size is excessively large, on the other hand, light scattering becomes substantial, vis-à-vis the case when the primary particle size lies within the above range, and visibility of the transparent conductive film 10 may be impaired.

The ZnO particles 13 are transparent particles comprising an additive component having zinc oxide (ZnO) as a main component thereof. The shape of the ZnO particles 13 may be spherical, needle-like, leaf-like or the like. The ZnO particles 13 may be formed of ZnO singly, or, provided that the main component is ZnO, may comprise other components mixed in and/or adhered to the surface. Herein, the feature "having ZnO as a main component thereof" means that the additive component comprises at least about 50 wt % of ZnO.

Besides being formed of ZnO alone, the ZnO particles 13 may also be embodied as follows. For instance, ZnO may be doped with aluminum (Al), gallium (Ga), lithium (Li), fluorine (F), nitrogen (N), a transition meal or the like. Preferably, the doping component is appropriately selected in accordance with the desired characteristics to be imparted to the transparent conductive layer 15. For instance, Al doping or Ga doping allow lowering the resistivity of the transparent conductive layer 15.

When doping ZnO with such components, the doping amount is preferably no greater than 40 wt %, more preferably no greater than 30 wt %, relative to the total amount of additive component. If the doping amount is excessive, the resistivity of the ZnO particles 13 increases and light transmittance decreases, and the effect elicited by adding the ZnO particles 13, namely of suppressing resistance increases caused by humidity, tends to become insufficient.

The form of the ZnO particles 13 includes, for instance, ZnO particles comprising ZnO alone, or particles of ZnO by itself having another component adhered to the surface thereof. Also, particles of ZnO having mixed another component thereinto may have yet another component adhered to the surface of the ZnO particles. All the foregoing are insulating particles comprising such a proportion of ZnO that makes ZnO the main component.

Examples of the ZnO particles 13 having ZnO particles onto the surface of which another component is adhered include, for instance, cores of ZnO having alumina or silica adhered to the surface. Specifically, the surface of ZnO cores may be covered with alumina or silica, or, alternatively, plural layers of alumina or silica may be formed on the surface of ZnO cores. The ZnO particles 13 having such a constitution acquire as a result greater stability to temperature and humidity. This allows further suppressing resistance increases in the transparent conductive layer 15 on account of moisture or the like. Reasons for the foregoing include, for instance, the fact that the surface of the ZnO particles 13 is inactivated by the cover of alumina and/or silica, which allows suppressing resistivity variations caused by oxidation and reduction; and that the covered ZnO particles 13, moreover, dissolve less readily in water, acids or the like, become less reactive to other components and exhibit improved dispersibility. The amount of alumina or silica covering the ZnO ranges preferably from 0.1 to 20 wt % relative to the total amount of additive component. When that amount is too small, the covering effect afforded by the alumina and/or silica is insufficient whereas an excessive surface cover hampers the formation of conductive paths between the ZnO particles 13, which results in higher resistance values and, in some cases, may cause transmittance to drop.

The surface of the ZnO cores in the ZnO particles 13 may also be covered by a transparent resin. Examples of such a resin include, for instance, polysiloxanes. Examples or particles in which the surface of a ZnO core is covered by a polysiloxane include, for instance, NANOFINE-50SD (by Sakai Chemical Industry Co. Ltd.). By way of the above constitution, adherence onto the substrate 14 is enhanced, while the contact surface with the ZnO particles 13 is increased on account of the resin shrinking that accompanies the curing reaction. An additional effect is prevention of oxidation and reduction on the surface of the ZnO particles 13. The amount of resin is preferably similar to that of the above-described silica or alumina.

It is particularly preferable that no more than 40% of the ZnO in the ZnO particles 13 be doped with Ga or Al, since resistivity in the transparent conductive layer 15 can be sufficiently reduced thereby, while resistance increases caused by moisture or the like can be adequately curbed.

The primary particle diameter of the ZnO particles 13 is preferably 0.005 to 0.5 μm, more preferably 0.01 to 0.08 μm. When the primary particle size is too small, control of oxygen vacancies becomes difficult, while environment resistance may decrease and conductivity of the transparent conductive film 10 may be impaired. On the other hand, an excessively large primary particle size results in substantial light scattering, which may impair the visibility of the transparent conductive film 10. Although the size correlation between the ITO particles 11 and the ZnO particles 13 is not particularly limited, the conductive performance of the transparent conductive film 10 tends to depend heavily on the ITO particles 11. When the ITO particles 11 are larger than the ZnO particles 13, therefore, conductive paths are easier to achieve, and the probability that the ZnO particles 13 come into contact with the ITO particles 11 becomes higher, which is advantageous for lowering resistivity. Making ITO particles 11 larger than ZnO particles 13 is thus preferable, since higher transmittance can also be obtained thereby.

The ITO particles 11 and the ZnO particles 13 are comprised in the transparent conductive layer 15 in the predetermined blending ratios below. Specifically, the content of additive component in the ZnO particles 13 ranges from 0.1 to 50 wt % relative to the total amount of the ITO comprised in the ITO particles 11 and the additive component. When the content of additive component is lower than 0.1 wt % or higher than 50 wt %, the rise in resistance in the transparent conductive layer 15 on account of moisture or the like becomes greater than is the case when the content of additive component lies within the above range. In terms of reducing such rises in resistance more effectively, the content of additive component ranges preferably from 1 to 30 wt %. A content of additive component no greater than 10 wt % is yet more effective, as it allows sufficiently lowering the resistance value itself of the transparent conductive layer 15.

Preferably, the above-described ITO particles 11 and the ZnO particles 13 comprised in the transparent conductive layer 15 form respective individual particles, but not a complex oxide by, for instance, reacting among them. The transparent conductive layer 15, however, may partly contain a complex oxide or the like that forms unavoidably on account of, for instance, contact between particles.

Besides the ITO particles 11 and the ZnO particles 13, the transparent conductive layer 15 comprises also the resin cured product 12. The resin cured product 12, which occupies the interstices between the particles, functions as a binder resin for binding the particles to one another. The resin cured product 12 that can be used is not particularly limited, provided that it is transparent to visible light and may be a known cured product of a thermosetting resin or photocurable resin. Examples thereof include, for instance, acrylic resins, epoxy resins, polystyrene, polycarbonate, norbornene resins, fluorocarbon resins, urethane resins or the like, preferably acrylic resins.

The transparent conductive film 10 having the above constitution can be manufactured in accordance with, for instance, the below-described manufacturing method.

Specifically, the above-described ITO particles 11 and ZnO particles 13 are prepared first, and then a dispersion thereof is obtained through dispersion in a solvent. Examples of the solvent that can be used include, for instance, alcohols such as methanol, ethanol, propanol, butanol or the like, as well as acetone, methyl ethyl ketone, methyl isobutyl ketone, cyclohexanone or the like. Dispersion can be cared out using, for instance, a medium agitating-type wet powder pulverizer, a container-driven medium-type wet powder pulverizer or a dry pulverizer, such as a bead mill, a vibrating ball mill or a planetary ball mill.

Next, the dispersion is coated onto the substrate 14 or the like such as the one described above. Thereafter, the solvent in the dispersion is removed by evaporation. A particle layer, comprising the dispersed and bonded ITO particles 11 and ZnO particles 13 forms as a result on the substrate 14. Coating of the dispersion can be carried out, for instance, by reverse roller, direct roller, blade, knife, extrusion, nozzle, curtain, gravure roller, bar coater, dipping, cast coating, spin coating, squeezing, spraying or the like.

Thereafter, a separate support member such as a PET film or the lie is further arranged on the particle layer formed on the substrate 14, and then the whole is pressed, in the lamination direction, using a pressure roller or the like. An aggregate is obtained thereby through aggregation of the ITO particles 11 and the ZnO particles 13 that make up the particle layer. The pressure thus exerted increases the contact surface area between particles, and contributes to achieving a conductivity-enhancing effect. When a transparent conductive layer 15 having sufficient characteristics can be obtained without pressing, the pressing step may be omitted.

After stripping the support substrate from the obtained aggregate, the aggregate is coated with a resin such as the above-described resins, for forming, through curing the resin cured product 12. The resin seeps thereby into the interstices between the ITO particles 11 and the ZnO particles 13 that make up the aggregate. The resin that can form the resin cured product 12 by curing may be, for instance, a monomer or an oligomer. The resin may seep into the aggregate in the form, for instance, of a solution in which the resin is dissolved in a solvent.

Thereafter, the resin cured product 12 is formed by curing the resin that permeates the aggregate. Curing of the resin may be appropriately selected in accordance with the type of resin. When the resin is a thermosetting resin, for instance, the laminate comprising the aggregate formed on the substrate 14 is heated enough so as to elicit curing of the resin. When the resin is a photocurable resin, the aggregate in the laminate is subjected to irradiation of light beams capable of eliciting curing of the resin.

Thereby, the ITO particles 11 and ZnO particles 13 that make up the aggregate become bonded, via the resin cured product 12, to form the transparent conductive layer 15 and yield as a result the transparent conducive film 10 having the above constitution.

The present invention is not necessarily limited to the transparent conductive film of the preferred embodiment, the transparent conductive layer (transparent conductor) suitable therefor, and the method for manufacturing the transparent conductive film that have been explained thus far.

For instance, in the above embodiment, although the transparent conductive film 10 have constituent where the transparent conductive layer 15 formed on the substrate 14, the transparent conductive film 10 need not necessarily comprise the substrate 14, and may comprise the transparent conductive layer 15 alone, if sufficient strength and so forth can be ensured.

Besides the above-described ITO particles 11, the resin cured product 12 and the ZnO particles 13, the transparent conductive layer 15 may further comprise other components, in accordance with desired characteristics to be achieved, provided that the effect of the present invention is not unduly lessened by such other components. The transparent conductive film 10 may further comprise other layers besides the substrate 14 and the transparent conductive layer 15. Further, the method of manufacturing the transparent conductive film is not limited to the manufacturing method, as the above-mentioned embodiment, where the resin using to formation of the resin cured product 12 is coated after a formation of the aggregate of the ITO particles 11 and the ZnO particles 13. The transparent conductive film can be formed by the method where a mixed liquid obtained by dispersing above particles to resin is prepared in advance, and then the mixed liquid is coated to the substrate 14 etc. Depending on the method of manufacturing the transparent conductive film, or types or properties of resin to be used, the transparent conductive film 10 shown in FIG. 2 described below may be obtained besides the transparent conductive film 10 shown in FIG. 1.

EXAMPLES

The present invention is explained in more detail below on the basis of examples. The present invention, however, is in no way meant to be limited to or by the examples.

Examples 1 to 9, Comparative Examples 1 to 4

In Examples 1 to 9 and Comparative examples 1 to 4 there were manufactured transparent conductive films by blending ITO (ITO particles) and an additive component (ZnO particles), to yield the ZnO particle contents given in Table 1 (content of ZnO particles expressed as weight percent relative to the total of ITO particles plus ZnO particles). In Comparative example 1 (ZnO particles 0%) only ITO particles were used, while in Comparative example 4 (ZnO particles 100%), only ZnO particles were used. The method for manufacturing the transparent conductive films was as follows.

(Preparation of Transparent Conductive Films)

Firstly, ITO particles (primary particle size=0.03 μm) having an average particle size no smaller than 20 nm were dispersed in 30 g of ethanol. To the resulting dispersion there was added, as ZnO particles, Ga-doped ZnO (GK-40, by Hakusui Tech, primary particle size=0.03 μm or smaller, resistance value (powder intrinsic resistivity)=500 Ω·cm), to prepare a dispersion (denoted hereinafter as ITO-ZnO particles). The total sum of ITO particles and ZnO particles used was 10 g.

The obtained dispersion was then coated onto a PET film, followed by removal of ethanol from the dispersion. Next, another PET film was placed on the layer obtained by drying, the coated liquid, whereafter the whole was pressed using a pressure roller. An aggregate of ITO particles and ZnO particles was obtained as a result.

One of the PET films was stripped from the aggregate, and then the latter was impregnated with a mixed solution comprising an uncured acrylic resin, methyl ethyl ketone (by Kanto Chemical Co. Inc.) and vinyltrimethoxysilane (by Shin-Etsu Chemical Co., Ltd.). The uncured acrylic resin used comprised an acrylic polymer (by Shin-Nakamura Chemical Co., Ltd.), acrylic monomers (by Shin-Nakamura Chemical Co., Ltd.), and a photopolymerization initiator.

Figure 2:
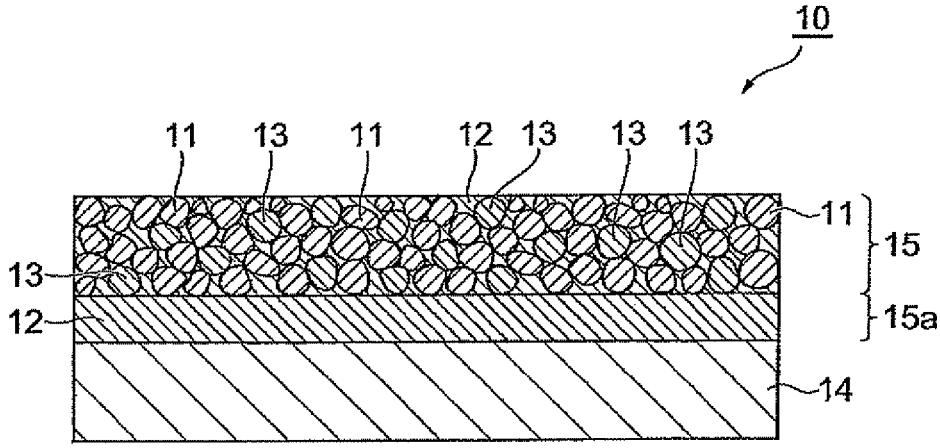
FIG. 2 is a diagram illustrated schematically the cross-sectional constitution of transparent conductive films obtained in examples and comparative examples.

Thereafter, the mixed solution impregnating the aggregate was dried, and then UV rays were irradiated onto the aggregate, to cure thereby the acrylic resin, and yield as a result a transparent conductive film. FIG. 2 is a diagram illustrating schematically the cross-sectional constitution of the transparent conductive film obtained in the examples and the comparative examples. As illustrated in FIG. 2, these transparent conductive films have a structure in which an interlayer 15*a* composed of the resin cured product 12 is arranged between the substrate 14 and the transparent conductive layer 15 in which the ITO particles 11 and the ZnO particles 13 are mixed within the resin cured product 12. The most outer surface of the substrate 14 is in touch with the resin cured product 12 only in these transparent conductive films by having such a constitution. As a result, the adhesiveness between the substrate 14 and the resin cured product 12 is improved, and then increase in the resistance value therebetween can be reduced. Further, the increase in the resistance value is also reduced by integration of the interlayer 15*a* and the resin cured product 12 in the transparent conductive layer 15.

(Resistance Value and Resistance Change Rate)

Firstly, the resistance value (Ω/□) of the transparent conductive films obtained in the examples and comparative examples was measured in accordance with a four-probe method. The transparent conductive films were then subjected to an environment test by being left to stand for 650 hours in an electric oven for environment testing (60° C., 95% RH). After the environment test, the resistance values of the transparent conductive films were measured in the same way as above. The resistance change in the transparent conductive films before and after the environment test were determined on the basis of the obtained results, to yield the resistance change rate (%).

Figure 3:
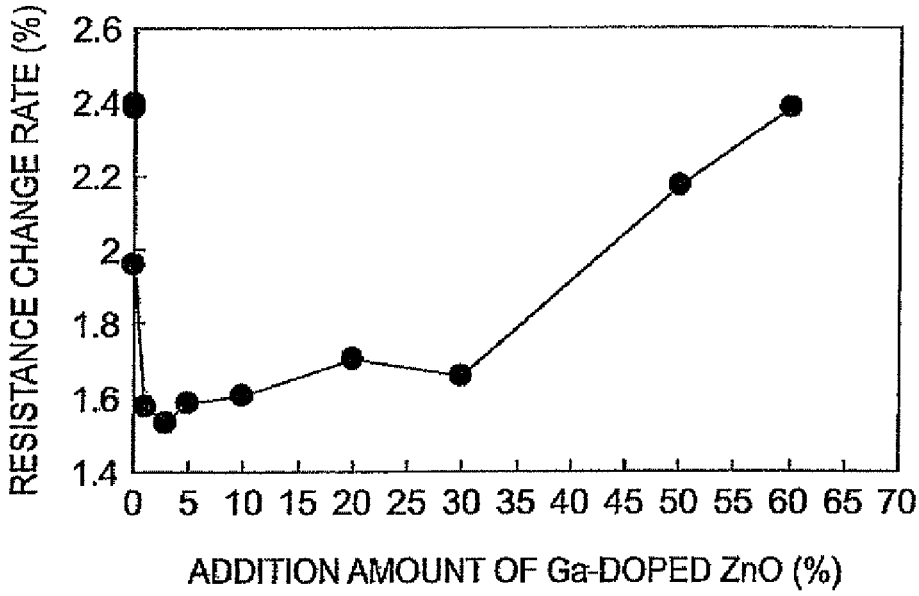
FIG. 3 is a graph of resistance change rate plotted against ZnO particle content (Ga-doped ZnO).

The obtained results are given in Table 1 and FIG. 3. FIG. 3 is a graph of the results obtained in Examples 1 to 9 and Comparative examples 1 to 4, in which the resistance change rate is plotted against the ZnO particle content (Ga-doped ZnO). In Table 1, the column "0 h" of resistance values gives the resistance values before the environment test, and the column "650 h" gives the resistance values after the environment test. The dash "-" in Comparative example 4 indicates that the resistance of the transparent conductive film of Comparative example 4 had increased, after the environment test, to a magnitude not measurable by the four-probe method.

TABLE 1

| Transparent conductive film | ZnO particle content (%) | Resistance value (Ω/□) 0 h | Resistance value (Ω/□) 650 h | Resistance change rate (%) |
|---|---|---|---|---|
| Comp. ex. 1 | 0 | 814.2 | 1938.6 | 2.38 |
| Comp. ex. 2 | 0.05 | 801.1 | 1921.2 | 2.40 |
| Example 1 | 0.1 | 789.3 | 1545.6 | 1.96 |

TABLE 1-continued

| Transparent conductive film | ZnO particle content (%) | Resistance value (Ω/□) 0 h | Resistance value (Ω/□) 650 h | Resistance change rate (%) |
|---|---|---|---|---|
| Example 2 | 1 | 812.2 | 1287.2 | 1.58 |
| Example 3 | 3 | 481.6 | 737.5 | 1.53 |
| Example 4 | 5 | 497.6 | 789.5 | 1.59 |
| Example 5 | 10 | 582.7 | 936.8 | 1.61 |
| Example 6 | 20 | 893.2 | 1519.6 | 1.70 |
| Example 7 | 30 | 1189.9 | 1974.5 | 1.66 |
| Example 8 | 40 | 2345 | 4338 | 1.85 |
| Example 9 | 50 | 4334 | 9399 | 2.17 |
| Comp. ex. 3 | 60 | 6546.6 | 15588 | 2.38 |
| Comp. ex. 4 | 100 | 727222.2 | — | — |

As Table 1 and FIG. 3 show, the resistance change rate can be markedly lowered in the transparent conductive films of Examples 1 through 9, where, in addition to ITO particles, there was added 0.1 to 50 mass % of ZnO particles, as compared with cases where ITO particles alone or ZnO particles alone are used (Comparative examples 1 and 4) or cases where the ZnO content lies beyond the 0.1 to 50 mass % range (Comparative examples 2 and 3). It was thus found that the transparent conductive films of Examples 1 through 9 exhibit a small increase in resistance value even when used under high-humidity conditions over long periods of time. If was further found that when the ZnO content ranges from 1 to 30 mass %, the resistance change rate can be made particularly low, not higher than 1.7%, such that increase in the resistance value can be suppressed after even a more prolonged use. When the ZnO content ranges from 3 to 10 mass %, in particular, the resistance value itself is low, of 1000Ω/□, which is particularly desirable in, for instance, touch panel applications.

Examples 10 to 16

(Preparation of Transparent Conductive Films)

The transparent conductive films of Examples 10 to 16 were prepared in the same way as in the examples above, but using herein, as the ZnO particles, those given in Table 2, with the ZnO particle content ratios given in Table 2. In Table 2, "alumina cover ZnO" denotes NANOFINE 75 particles, by Sakai Chemical Industry Co. Ltd.; "cross-linking agent added ZnO" denotes NANOFINE P-1 (primary particle size=0.02 μm, surface untreated) by Sakai Chemical Industry Co. Ltd.; "Al-doped ZnO" denotes SC-18, by Sakai Chemical Industry Co. Ltd (primary particle size=0.02 μm, resistance value (powder intrinsic resistivity)=500 Ω·cm), by Sakai Chemical Industry Co. Ltd.; and "Non-doped ZnO" denotes ZnO particles without any additive, comprising ZnO alone. Also, the "alumina cover ZnO 10%" in Table 2 denotes the use of "alumina cover ZnO" as the ZnO particles, to a content of 10 mass % relative to the total of ITO particles and ZnO particles. The same notation applies to the contents (%) of the other components in Table 2.

(Resistance Value and Resistance Change Rate)

The resistance value and resistance change rate of the transparent conductive films obtained in Examples 10 to 16 were measured in the same way as above. The obtained results are summarized in Table 2 together with the results of Example 5.

TABLE 2

| Transparent conductive film | Type and content of ZnO particles (%) | Resistance value (Ω/□) 0 h | 650 h | Resistance change rate (%) |
|---|---|---|---|---|
| Example 10 | Alumina cover ZnO 10% | 584.2 | 973.2 | 1.67 |
| Example 11 | Alumina cover ZnO 30% | 1418.5 | 2493 | 1.76 |
| Example 12 | Cross-linking agent added ZnO 10% | 590.7 | 949 | 1.61 |
| Example 13 | Cross-linking agent added ZnO 30% | 1294.9 | 2133 | 1.65 |
| Example 5 | Ga-doped ZnO 10% | 582.7 | 936.8 | 1.61 |
| Example 14 | Ga-doped ZnO 30% | 1189.9 | 1974.5 | 1.66 |
| Example 15 | Al-doped ZnO 10% | 976.7 | 1632.5 | 1.67 |
| Example 16 | Non doped ZnO 3% | 851.9 | 1512.5 | 1.78 |

As Table 2 shows, combining ITO particles and ZnO particles at specific blending ratios allows reducing considerably the resistance change rate, as compared with the above-described Comparative examples 1 to 4, even when using various kinds of ZnO particles. It was thus found that the transparent conducive films of Examples 10 through 16 exhibit a small increase in resistance value even when used under high-humidity conditions over long periods of time.

What is claimed is:

1. A transparent conductor, comprising:

indium tin oxide particles, particles of zinc oxide, doped with gallium, and a resin cured product, wherein the content of the particles of zinc oxide doped with gallium is 1 to 30 wt % relative to the total amount of the indium tin oxide particles and the particles of zinc oxide doped with gallium.

2. The transparent conductor according to claim 1, wherein the particles of zinc oxide doped with gallium further comprise insulating particles adhered to surfaces of the particles of zinc oxide doped with gallium, the insulating particles comprising at least one of alumina, silica and a resin.

* * * * *